US007892716B2

(12) United States Patent
Cheong et al.

(10) Patent No.: US 7,892,716 B2
(45) Date of Patent: Feb. 22, 2011

(54) METHOD OF PREPARING CORE-SHELL TONER AND TONER PREPARED USING THE METHOD

(75) Inventors: Min-young Cheong, Seoul (KR); Kyung-yol Yon, Seongnam-si (KR); Chang-kook Hong, Suwon-si (KR); Jun-young Lee, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 1130 days.

(21) Appl. No.: 11/523,664

(22) Filed: Sep. 20, 2006

(65) Prior Publication Data

US 2007/0072107 A1 Mar. 29, 2007

(30) Foreign Application Priority Data

Sep. 24, 2005 (KR) ..... 10-2005-0089043

(51) Int. Cl.
*G03G 9/093* (2006.01)

(52) U.S. Cl. ..... 430/110.2; 430/123.5; 430/137.11

(58) Field of Classification Search ..... 430/110.2, 430/109.4, 137.11, 123.5
See application file for complete search history.

(56) References Cited

U.S. PATENT DOCUMENTS

| | | | | |
|---|---|---|---|---|
| 5,604,076 | A | 2/1997 | Patel et al. | |
| 5,958,640 | A * | 9/1999 | Hasegawa et al. | 430/110.2 |
| 6,132,919 | A * | 10/2000 | Ogawa et al. | 430/110.2 |
| 6,342,328 | B1 * | 1/2002 | Takasaki et al. | 430/108.22 |
| 2001/0000743 | A1 | 5/2001 | Yuasa et al. | |

FOREIGN PATENT DOCUMENTS

| | | | |
|---|---|---|---|
| CN | 1246659 | | 3/2000 |
| EP | 952495 | A1 * | 10/1999 |
| JP | 59-170851 | A * | 9/1984 |
| JP | 06-317925 | | 11/1994 |
| JP | 10-177278 | | 6/1998 |
| JP | 2002365849 | A * | 12/2002 |
| JP | 2003-005432 | | 1/2003 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

* cited by examiner

*Primary Examiner*—Christopher RoDee
(74) *Attorney, Agent, or Firm*—Roylance, Abrams, Berdo & Goodman, L.L.P.

(57) ABSTRACT

A method of preparing a toner, includes: preparing a core by mixing a polyester resin and a colorant with at least one material selected from the group consisting of a macromonomer having hydrophilic group, hydrophobic group, and at least one reactive functional group and a reactive emulsifying agent. A shell is formed on the core by polymerizing the exterior surface of the core with one or more polymerizable monomers and an initiator, wherein at least one material selected from the group consisting of the macromonomer and the reactive emulsifying agent participate in the polymerization reaction. Also, provided are a toner prepared using the method, an image forming method using the toner, and an image forming apparatus employing the toner. According to the method, a polyester resin, having superior fixability at low temperature and image properties, is used as a core composition and styrene, having superior maintenance and charging properties, is used as a shell composition in the process of manufacturing a core/shell structure to prepare the toner for the image forming apparatus having fast speed and fixability of high quality images at low temperature. In addition, by not using the reactive emulsifying agent, the cleaning process is minimized, and the amounts of polluted water and waste water are decreased, which is very advantageous environmentally.

10 Claims, 1 Drawing Sheet

METHOD OF PREPARING CORE-SHELL TONER AND TONER PREPARED USING THE METHOD

CROSS-REFERENCE TO RELATED PATENT APPLICATION

This application claims the benefit of Korean Patent Application No. 10-2005-0089043, filed on Sep. 24, 2005, in the Korean Intellectual Property Office, the disclosure of which is hereby incorporated by reference in its entirety.

BACKGROUND OF THE INVENTION

1. Field of the Invention

The present invention relates to a method of preparing a toner and the toner prepared using the method. More particularly, the invention is directed to a method of preparing a toner having a core formed of a polyester resin and a colorant, wherein the core is encapsulated with a macromonomer and/or a reactive emulsifying agent and a polymerizable monomer resin. The invention is also directed to a toner prepared using the method.

2. Description of the Related Art

In an electrophotographic process or an electrostatic recording process, a developer is used to form an electrostatic image or an electrostatic latent image. The electrostatic image may be a two-component developer formed of a toner and carrier particles or a one-component developer formed of a toner only, without carrier particles. The one-component developer may be a magnetic one-component developer having magnetic properties or a nonmagnetic one-component developer not having magnetic properties. Plasticizers such as colloidal silica are often added independently into the nonmagnetic one-component developer to increase the flowability of the toner. Generally, coloring particles obtained by dispersing a colorant, such as carbon black, or other additives in a binding resin are used in the toner.

Methods of preparing toners can include a pulverization or a polymerization step. In the method including the pulverization step, the toner is obtained by melt mixing synthetic resins with colorants and, if needed, other additives, pulverizing the mixture and classifying the particles until a desired size of particles is obtained. A polymerizable monomer composition is produced by uniformly dissolving or dispersing a polymerizable monomer, a colorant, a polymerization initiator and, if needed, various additives such as a cross-linking agent and an antistatic agent. Next, the polymerizable monomer composition is dispersed in an aqueous dispersive medium which includes a dispersion stabilizer using an agitator to form minute liquid droplets. Subsequently, the temperature is increased and suspension polymerization is performed to obtain a polymerized toner having colored polymer particles of a desired size.

In an image forming apparatus such as an electrophotographic apparatus or an electrostatic recording apparatus, an electrostatic latent image is formed through light-exposure on the surface of a photoreceptor which is uniformly charged. A toner is attached to the electrostatic latent image, and a resulting toner image is transferred to a transfer medium such as a paper through several processes such as heating, pressing, solvent steaming, etc. In most fixing processes, the transfer medium with the toner image passes through fixing rollers and pressing rollers, where the toner image is fused to the transfer medium by heat and pressure.

Improvements in preciseness and minuteness are-required for images formed by an image forming apparatus such as an electrophotocopier. Conventionally, a toner used in an image forming apparatus is usually obtained using a pulverization step. When using a pulverization step, colored particles with a wide range of particle sizes are often formed. Hence, to obtain satisfactory developer properties, there is a need to classify the colored particles obtained through pulverization according to size to narrow the particle size distribution. However, it is difficult to precisely control the particle size distribution using a conventional mixing/pulverizing process in the manufacture of toner particles suitable for an electrophotographic process or electrostatic recording process. Also when preparing a minute particle toner, the toner preparation yield is low as a result of the classification process. In addition, there is a limit to the change/adjustment of a toner design for obtaining desirable charging and fixing properties. Accordingly, polymerized toners, in which the size of particles is easy to control and which do not need to go through a complex manufacturing process such as classification, have recently become of interest.

When a toner is prepared using polymerization, the desired size distribution of particles is obtained without performing pulverization or classification.

U.S. Pat. No. 6,033,822 to Hasegawa et al. discloses a polymerized toner including a core formed of colored polymer particles and a shell covering the core in molecules, wherein the polymerized toner is prepared by suspension polymerization. However, it is still difficult to adjust the shape of the toner and the sizes of the particles. This process also produces a wide particle size distribution.

U.S. Pat. No. 6,258,911 to Michael et al. discloses a bifunctional polymer having a narrow polydispersity and an emulsion-condensation polymerization process for manufacturing a polymer having covalently bonded free radicals on each of its ends. However, even when this method is used, a surfactant can cause an adverse effect, and it is difficult to control the size of latex.

SUMMARY OF THE INVENTION

The present invention provides a method of preparing a toner in which the size of the toner particle is controlled freely, the narrow particle size distribution is obtained, and the durability of toner is superior.

The present invention also provides a toner having a small particle size and excellent storage property and durability. The particle size of the toner can be easily controlled and produced in high yield by the method of the invention.

The present invention also provides an image forming method in which a high quality image can be fused at a low temperature using the toner of the invention having superior properties in particle size control, storage property, and durability.

The present invention also provides an image forming apparatus in which a high quality image can be fused at a low temperature using the toner of the invention having superior properties in particle size control, storage property, and durability.

According to an aspect of the present invention, a method is provided for preparing a toner, including the steps of: preparing a core by mixing a polyester resin and a colorant with at least one of a macromonomer having hydrophilic group, hydrophobic group, and at least one reactive functional group and a reactive emulsifying agent; and preparing a shell by polymerizing the exterior surface of the core with one or more polymerizable monomer and an initiator, wherein at least one of the macromonomer and the reactive emulsifying agent participate in the polymerization reaction.

According to another aspect of the present invention, a toner is provided including a core and a shell, wherein the core is prepared by mixing a polyester resin and a colorant with at least one of a macromonomer having hydrophilic group, hydrophobic group, and at least one reactive functional group and a reactive emulsifying agent; and wherein the shell is prepared by polymerizing the exterior surface of the core with one or more polymerizable monomers and an initiator, wherein at least one of the macromonomer and the reactive emulsifying agent participate in the polymerization reaction.

According to another aspect of the present invention, an image forming method is provided including the steps of: forming a visible image by disposing the toner described above on an photoreceptor surface where an electrostatic latent image is formed; and transferring the visible image to a transfer medium.

According to another aspect of the present invention, an image forming apparatus is provided including: an organic photoreceptor; a unit for electrifying a surface of the organic photoreceptor; a unit for containing the toner; a unit for supplying the toner to the surface of the organic photoreceptor to develop an electrostatic latent image on the surface of the organic photoreceptor into a toner image; and a unit for transferring the toner image on the surface of the organic photoreceptor to a transfer medium.

According to the present invention, a toner is provided with an easy preparation method and regulation of particle size, and superior storage and durability.

These and other aspects of the invention will become apparent from the following detailed description of the invention and the annexed drawings which disclose various embodiments of the invention.

BRIEF DESCRIPTION OF THE DRAWING

The above and other features and advantages of the present invention will become more apparent by describing in detail exemplary embodiments thereof with reference to the attached drawing in which.

DETAILED DESCRIPTION OF THE INVENTION

Figure 1:
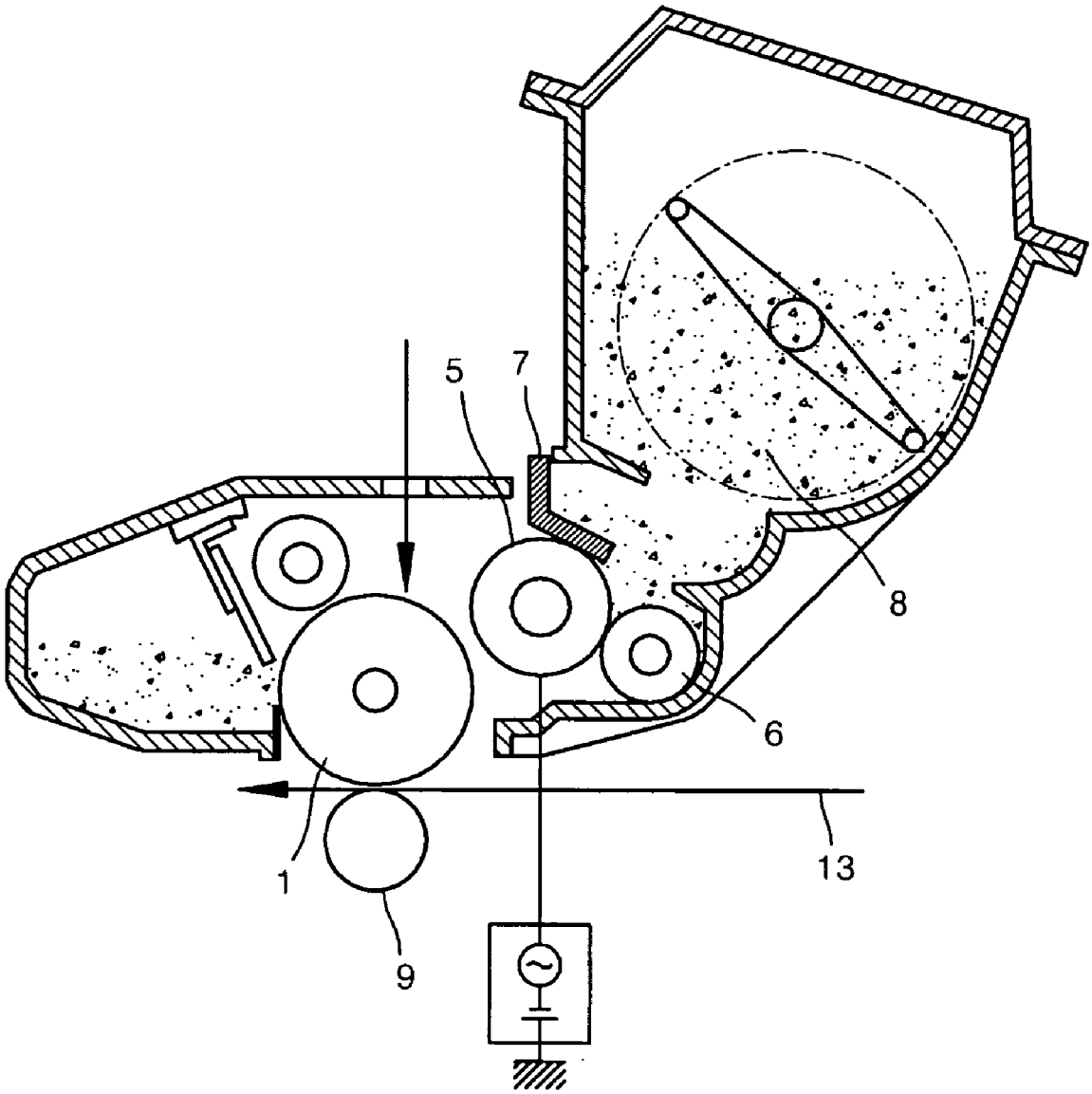
FIG. 1 is a schematic diagram of an image forming apparatus employing a toner prepared by the method according to an embodiment of the present invention.

The present invention provides a method of preparing a toner, including: preparing a core by mixing a polyester resin and a colorant with at least one material selected from the group consisting of a macromonomer having hydrophilic group, hydrophobic group, and at least one reactive functional group and a reactive emulsifying agent; and preparing a shell by polymerizing the exterior surface of the core with one or more polymerizable monomer and an initiator, wherein at least one material selected from the group consisting of the macromonomer and the reactive emulsifying agent participate in the polymerization reaction.

According to the present invention, a toner is produced having a core formed of a polyester resin and a colorant, wherein the core is encapsulated with a macromonomer and/or a reactive emulsifying agent and at least one polymerizable monomer. By using the polyester resin in the core, the toner has a gloss suitable for fusing at a low temperature and graphic printing. Also, encapsulating the surface of the toner with the polymerizable monomer improves the storability and charging properties of the toner particles. The encapsulation process uses the macromonomer and/or the reactive emulsifying agent. The reactive emulsifying agent bonds to a latex resin during the reaction of particle formation, which improves toner properties since there is no migration of remaining reactive emulsifying agent in the toner.

In detail, the polyester resin and the colorant are dissolved or dispersed in an organic solvent and injected into a reactor where the macromonomer and/or the reactive emulsifying agent are dissolved in water. During injection, at least one material selected from the group consisting of wax, a charge control agent and a release agent may be additionally injected selectively. The mixture is dispersed using a homogenizer or an ultrasonic homogenizer for several minutes, and stirred sufficiently at a suitable temperature to remove the organic solvent to form the core. When the organic solvent is removed sufficiently, the temperature inside the reactor is increased to an optimum level, at least one polymerizable monomer is injected, and the initiator is injected to cause the radical reaction to form the shell.

During the polymerization reaction of the shell, an electrolyte such as NaCl, or an ionic salt may be added to regulate the intensity of ions in the reactive medium. Through this process, the size of the final toner particles can be regulated. To regulate the size and configuration of the toner particles, an agglomeration process may be performed. The toner particles obtained after the polymerization reaction are separated and dried after a filtration process. The dried toner may finally be used for an image forming apparatus after adding an additive.

The polyester resin may include a polyester moiety and at least two reactive groups selected from the group consisting of a vinyl group, an acrylate group, and a methacrylate group.

The weight average molecular weight of the polyester resin may be in the range of 5,000 to 120,000, and preferably in the range of 20,000 to 50,000. When the weight average molecular weight of the polyester resin is less than 5,000, the durability of the toner decreases, and when it exceeds 120,000, the fixation of the toner decreases.

The amount of the polyester resin may be in the range of 1,000 to 10,000 parts by weight based on 100 parts by weight of the colorant. When the amount of the polyester resin is less than 1,000 parts by weight, the durability of the toner decrease, and when it exceeds 10,000 parts by weight, the coloring efficiency of the toner decreases.

The present invention stabilizes the particles during the reaction or after the reaction by using a macromonomer. The macromonomer according to the present invention is an amphipathic material having both a hydrophilic group and a hydrophobic group, and a polymer or an oligomer having at least one reactive functional group. The hydrophilic group reacts with a medium which improves the water dispersion of the monomer, and the hydrophobic group promotes the emulsion polymerization by lying on the surface of toner particles. The macromonomer can form a copolymer by binding with a polymerizable monomer in the toner composition in various ways, such as grafting, branching or cross-linking. By using the macromonomer according to an embodiment of the present invention, the durability and anti-offset of toner particles can be improved. Also, the macromonomer can act as a stabilizer by forming stabilized micelles during the emulsion polymerization.

The weight average molecular weight of the macromonomer is in the range of 100 to 100,000, and preferably in the range of 1,000 to 10,000. When the weight average molecular weight of the macromonomer is less than 100, the properties of the toner may not be improved or the macromonomer may not function properly as a stabilizer. Also, when the weight average molecular weight of the macromonomer is greater than 100,000, a reaction conversion rate may be low.

The macromonomer according to the present invention may be, for example, a material selected from the group consisting of polyethylene glycol (PEG)-methacrylate, PEG-ethyl ether methacrylate, PEG-dimethacrylate, PEG-modified urethane, PEG-modified polyester, polyacrylamide (PAM), PEG-hydroxyethyl methacrylate, hexafunctional polyester acrylate, dendritic polyester acrylate, carboxy polyester acrylate, fatty acid modified epoxy acrylate and polyester methacrylate, but is not limited thereto.

The reactive emulsifying agent includes a polyoxyethylene alkylphenyl ether moiety and may include at least one material selected from the group consisting of an anionic reactive emulsifying agent having a vinyl group, an acrylate group and a methacrylate group. The reactive emulsifier, as known in the art, contains a reactive group, a hydrophilic group and a hydrophobic group. The reactive group can be a radical polymerizable unsaturated bond, such as a vinyl group, an acrylate group, or methacrylate group. The hydrophilic group can be a polyethylene oxide, hydroxyl, carboxyl, sulfonic acid, sulfuric acid or amino group. The hydrophobic group can be an alky, phenyl, fluoroalkyl, or polysiloxane group. Examples of reactive emulsifiers can have an allyl ether group, a polyethylene oxide group, and a nonylphenyl group such as those sold by Adeka Reasoap under the tradenames NE-10, NE-20 and NE-30. Other examples of reactive emulsifiers have an allyl ether group, a polyethylene oxide group, a sulfiric acid group and a nonylphenyl group from Asahi Denka Kogyo K.K., a propenyl group on a phenyl group in a polyoxyethylene nonyl phenyl ether group, and a propenyl group on a phenyl group in a polyoxyethylene nonyl phenyl ether sulfate ester group from Dai-ichi Kogyo Seiyaku Co., Ltd. Another example has an allyl group and a sulfonic acid group by Kao Corporation. Still other examples are available from Nippon Ngukazai Co., Ltd. including bis(polyoxyethylene polycyclic phenyl ether) methacrylate sulfate ester salt, polyoxythyline nonyl phenyl ether acrylates, polyoxyethylene alkyl ether methacrylates and polyoxyethylene methacrylate esters. Another example is a polyoxyethylene alkylphenyl ether ammonium sulfate.

The weight average molecular weight of the reactive emulsifying agent may be in the range of 100 to 1,000. When the weight average molecular weight of the reactive emulsifying agent is less than 100, the function as an emulsifying agent decreases, and when it exceeds 1,000, the reactivity thereof falls.

The amount of the reactive emulsifying agent may be in the range of 5 to 50 parts by weight, and preferably, in the range of 10 to 20 parts by weight based on 100 parts by weight of the colorant. When the amount of the reactive emulsifying agent is less than 5 parts by weight, the dispersibilities of the colorant and latex are reduced and the particle configuration deteriorates. When the amount exceeds 50 parts by weight, the reactivity of the emulsifying agent to the monomer is low.

The present invention does not use conventional emulsifying agents during the dispersion of the colorant, but instead uses a reactive emulsifying agent. The reactive emulsifying agents bond to latex resins during the reaction of particle formation, so the adverse effects on the toner properties generally caused by the emulsifying agent can be minimized since there is no migration of remaining or residual emulsifying agent. Since the present invention does not use the conventional emulsifying agents used for emulsion polymerization, a cleaning process during separation and filtration processes of the toner particles prepared may be minimized. Thus, the preparation process is simplified, production costs are reduced, and generation of polluted water and waste water is decreased, which is very advantageous environmentally. In addition, characteristics such as low friction electric charge and low toner storage stability can be improved and image deterioration due to the emulsifying agents can be prevented.

An electrophotographic developer according to the present invention may include a colorant, which can be carbon black or aniline black in the case of a black toner. Also, it is easy to produce a color toner with a nonmagnetic toner according to an embodiment of the present invention. In the case of a color toner, carbon black is used as a colorant for black, and a yellow colorant, a magenta colorant and a cyan colorant are alternatively included as colorants for the colors.

The yellow colorant may be a condensed nitrogen compound, an isoindolinone compound, an anthraquinone compound, an azo metal complex, or an aryl imide compound. For example, C.I. pigment yellow 12, 13, 14, 17, 62, 74, 83, 93, 94, 95, 109, 110, 111, 128, 129, 147, 168, 180, etc. may be used.

The magenta colorant may be a condensed nitrogen compound, anthraquinone, a quinacridone compound, a lake pigment of basic dye, a naphthol compound, a benzoimidazole compound, a thioindigo compound, or a perylene compound. For example, C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, etc. may be used.

The cyan colorant may be a copper phthalocyanine compound or a derivative thereof, an anthraquinone compound, or a lake pigment of basic dye. For example, C.I. pigment blue 1, 7, 15, 15:1, 15:2, 15:3, 15:4, 60, 62, 66, etc. may be used.

These colorants may be used alone or in combinations of two or more types. A desired colorant is selected according to the desired color, saturation, brightness, weatherability, and dispersability in a toner.

The amount of the colorant may be in the range of 0.1 to 20 parts by weight based on the 100 parts by weight of a polymerizable monomer. The amount of the colorant is not particularly limited as long as it is sufficient to color the toner. When the amount of the colorant is less than 0.1 parts by weight, the coloring is insufficient. When the amount of the colorant exceeds 20 parts by weight, the production costs of the toner increases and the toner is unable to obtain enough triboelectric charge.

The polymerizable monomer used for the shell of the present invention, may be formed of at least one material selected from the group consisting of styrene-based monomer such as styrene, vinyltoluene, and α-methylstyrene; acrylic acid and methacrylic acid; (meth)acrylic acid derivative such as methylacrylate, ethylacrylate, propylacrylate, butylacrylate, 2-ethylhexylacrylate, dimethylaminoethylacrylate, methylmethacrylate, ethylmethacrylate, propylmethacrylate, butylmethacrylate, 2-ethylhexylmethacrylate, dimethylaminoethylmethacrylate; (meth)acrylic acid derivative of amide selected from the group consisting of acrylonitrile, methacrylonitrile, acrylamide and methacrylamide; ethylenically unsaturated monoolefin such as ethylene, propylene and butylene; halogenated vinyl such as vinyl chloride, vinylidene chloride and vinyl fluoride; vinyl ester such as vinyl acetate and vinyl propionate; vinyl ether such as vinyl methyl ether and vinyl ethyl ether; vinyl ketone such as vinyl methyl ketone and methyl isopropenyl ketone; vinyl compound having nitrogen such as 2-vinyl pyridine, 4-vinyl pyridine and N-vinyl pyrrolidone, but is not limited thereto. Preferably, the polymerizable monomer may be formed of styrene-based monomer such as styrene, vinyltoluene, and α-methylstyrene.

The amount of the polymerizable monomer used in an embodiment of the present invention is in the range of 3 to 50 parts by weight based on 100 parts by weight of the toner composition. When the amount of the polymerizable monomer is less than 3 parts by weight based on 100 parts by weight of the toner composition, the yield is low. When the amount of the polymerizable monomer exceeds 50 parts by weight based on 100 parts by weight of the toner composition, the stability of the toner composition is low.

The macromonomer according to the present invention can act not only as a comonomer but also as a stabilizer. The reaction between initial radicals and monomers forms oligomer radicals, and provides an in situ stabilizing effect. The initiator decomposed by heat forms a radical, reacts with a monomer unit in an aqueous solution to form an oligomer radical, and increases hydrophobicity. The hydrophobicity of the oligomer radical accelerates the diffusion inside the micelle, accelerates the reaction with polymerizable monomers and facilitates a copolymerization reaction with a macromonomer.

Owing to the hydrophilicity of an amphipathic macromonomer, a copolymerization reaction can more easily occur in the vicinity of the surface of toner particles. The hydrophilic portion of the macromonomer located on the surface of the particle increases the stability of the toner particle by providing steric stability, and can control the particle size according to the amount or molecular weight of the injected macromonomer. Also, the functional group which reacts on the surface of the particle can improve the frictional electricity properties of the toner.

Radicals in the toner composition are formed by the initiator, and the radical may react with the polymerizable monomer. The radical reacts with the polymerizable monomer and the reactive functional group of the macromonomer to form a copolymer.

Examples of the radical polymerized initiator include persulfates, such as potassium persulfate, ammonium persulfate, etc.; azo compounds, such as 4,4-azobis(4-cyanovaleric acid), dimethyl-2,2'-azobis(2-methylpropionate), 2,2-azobis (2-amidinopropane)dihydrochloride, 2,2-azobis-2-methyl-N-1,1-bis(hydroxymethyl)-2-hydroxyethylpropionamide, 2,2'-azobis(2,4-dimethylvaleronitrile), 2,2'-azobisisobutyronitrile, 1,1'-azobis(1-cyclohexanecarbonitrile), etc.; peroxides, such as methylethylperoxide, di-t-butylperoxide, acetylperoxide, dicumylperoxide, lauroylperoxide, benzoylperoxide, t-butylperoxide-2-ethylhexanoate, di-isopropylperoxydicarbonate, di-t-butylperoxyisophthalate, etc. Also, an oxidation-reduction initiator, which is a combination of a polymerized initiator and a reducing agent, may be used.

The toner composition according to the present invention may include at least one material selected from the group consisting of wax, a chain transfer agent, a charge control agent, and a release agent.

The release agent protects a photoreceptor and prevents deterioration of developing properties, and thus may be used for the purpose of obtaining a high quality image. A release agent according to an embodiment of the present invention may use a solid high purity fatty acid ester material. For example, a low molecular weight polyolefin, such as low molecular weight polyethylene, low molecular weight polypropylene, low molecular weight polybutylene, etc.; paraffin wax; or a multifunctional ester compound, etc. may be used. The release agent used in an embodiment of the present invention may be a multifunctional ester compound formed of an alcohol having at least three functional groups and a carboxylic acid.

The charge control agent may be formed of a material selected from the group consisting of a salicylic acid compound containing a metal, such as zinc or aluminum, a boron complex of bisdiphenylglycolic acid, and silicate. More particularly, dialkyl salicylic acid zinc or boro bis(1,1-diphenyl-1-oxo-acetyl potassium salt) may be used.

A suitable wax which provides a desired characteristic of the final toner compound may be used. The wax may be polyethylene wax, polypropylene wax, silicon wax, paraffin wax, ester wax, carnauba wax or metallocene wax, but is not limited thereto. The melting point of the wax may be in the range of about 50 to about 150° C. The wax components physically adhere to the toner particles, but do not covalently bond with the toner particles. The toner fixes to a final image receptor at a low fixation temperature and has superior final image durability and antiabrasion property.

The present invention also provides a toner including a core and a shell, wherein the core is prepared by mixing a polyester resin and a colorant with at least one material selected from the group consisting of a macromonomer having hydrophilic group, hydrophobic group, and at least one reactive functional group and a reactive emulsifying agent. The shell is prepared by polymerizing the exterior surface of the core with one or more polymerizable monomers and an initiator, wherein at least one material selected from the group consisting of the macromonomer and the reactive emulsifying agent participate in the polymerization reaction.

A radical in the toner composition is formed by the initiator, and the radical may react with the polymerizable monomer, the reactive functional group of the macromonomer, and the reactive emulsifying agent to form a copolymer. The weight average molecular weight of the copolymer may be in the range of 2,000 to 200,000.

The average volumetric particle size of the toner particles prepared according to the present invention may be in the range of 0.5 to 20 μm and preferably, in the range of 5 to 10 μm.

The toner may further include at least one material selected from the group consisting of wax, a charge control agent, and a release agent, the details of which are as described above.

The present invention also provides an image forming method including: forming a visible image by disposing a toner on an photoreceptor surface where an electrostatic latent image is formed to form a visible image. The visible image is transferred to a transfer medium. The toner includes a core and a shell, wherein the core is prepared by mixing a polyester resin and a colorant with at least one material selected from the group consisting of a macromonomer having a hydrophilic group, a hydrophobic group, and at least one reactive functional group and a reactive emulsifying agent. The shell is prepared by polymerizing the exterior surface of the core with one or more polymerizable monomers and an initiator, wherein at least one material selected from the group consisting of the macromonomer and the reactive emulsifying agent participate in the polymerization reaction.

An electrophotographic image forming process includes a charging step, a light-exposing step, a developing step, a transferring step, a fusing step, a cleaning step and an erasing step, which are a series of steps to form an image on an image receptor.

In the charging process, the photoreceptor is covered with electric charges of desired polarity, which can be either negative or positive, by a corona or a charging roller. In the light-exposing process step, an optical system, generally a laser scanner or an array of diodes, forms a latent image corresponding to a final visual image to be formed on an image receptor by selectively discharging the charging surface of the photoreceptor in an imagewise manner. The electromagnetic radiation (hereinafter, "light") may include infrared radiation, visible rays and ultraviolet radiation.

In the developing process step, in general, the toner particles with suitable polarity contact the latent image on the photoreceptor, and typically, an electrically biased developer which has a potential with the same polarity as the toner is used. The toner particles move to the photoreceptor, selectively adhere to the latent image through static electricity and form a toner image on the photoreceptor.

In the transferring process step, the toner image is transferred from the photoreceptor to a desired final image receptor. Sometimes an intermediate transferring element is used to effect the transfer of the toner image from the photoreceptor to the final image receptor.

In the fusing process step, the toner image is fused to the final image receptor by melting or softening the toner particles by heating the toner image on the final image receptor. Alternatively, the toner can be fixed to the final image receptor under high pressure while being heated or without heating. In the cleaning process step, the toner particles remaining on the photoreceptor are removed. In the erasing process, an electric charge on the photoreceptor is exposed to light of a certain wavelength, and the electric charge is substantially decreased to a uniform low value. Consequentially, a residue of the latent image is removed and the photoreceptor is prepared for the next image forming cycle.

The present invention also provides an image forming apparatus including: an organic photoreceptor; a unit for electrifying a surface of the organic photoreceptor; a unit for containing a toner including a core and a shell, wherein the core is prepared by mixing a polyester resin and a colorant with at least one material selected from the group consisting of a macromonomer having a hydrophilic group, a hydrophobic group, and at least one reactive functional group, and a reactive emulsifying agent. The shell is prepared by polymerizing the exterior surface of the core with one or more polymerizable monomers and an initiator, wherein at least one material selected from the group consisting of the macromonomer and the reactive emulsifying agent participate in the polymerization reaction. A unit for supplying the toner to the surface of the organic photoreceptor is included to develop an electrostatic latent image on the surface of the organic photoreceptor into a toner image. A unit for transferring the toner image on the surface of the organic photoreceptor to a transfer medium is also included.

FIG. 1 is a schematic diagram of a non-contact developing type image forming apparatus using a toner prepared using the method according to an embodiment of the present invention. The operating principles of the image forming apparatus are explained below.

A developer 8, which is a nonmagnetic one-component developer, is supplied to a developing roller 5 through a feeding roller 6 formed of an elastic material such as a polyurethane in a solid form or a resilient foam. The developer 8 supplied to the developing roller 5 reaches a contact point between the developing roller 5 and a developer regulation blade 7 as the developing roller 5 rotates. The developer regulation blade 7 is formed of an elastic or flexible material such as metal, rubber, etc. When the developer 8 passes the contact point between the developing roller 5 and the developer regulation blade 7, the developer 8 is smoothed to form a thin layer and the developer 8 is sufficiently charged. The developing roller 5 transfers the thin layer of the developer 8 to a developing domain where the developer 8 is developed on the electrostatic latent image of a photoreceptor 1, which is a latent image carrier.

The developing roller 5 and the photoreceptor 1 face each other with a constant distance therebetween without contacting each other. The developing roller 5 rotates counterclockwise and the photoreceptor 1 rotates clockwise. The amount of the developer 8 transferred to the developing domain forms an electrostatic latent image on the photoreceptor 1 according to the intensity of an electric charge generated due to a difference between a voltage applied to the developing roller 5 and a latent image potential of the photoreceptor 1.

The developer 8 developed on the photoreceptor 1 reaches a transferring device 9 as the photoreceptor 1 rotates. The developer 8 developed on the photoreceptor 1 is transferred through corona discharging or by a roller to a printing paper 13 as the printing paper 13 passes between the photoreceptor 1 and the transferring device 9 by the transferring device 9. A high voltage with an opposite polarity to the developer 8 is applied to the transferring device 9, and thus forms an image.

The image transferred to the printing paper 13 passes through a fusing device (not shown) that provides high temperature and high pressure to fuse the image to the printing paper 13 by fusing the developer 8 to the printing paper 13. Any remaining developer 8 on the developing roller 5 which is not developed is taken back by the feeding roller 6 contacting the developing roller 5. The above processes are repeated.

The present invention will now be described in greater detail with reference to the following examples. The following examples are for illustrative purposes only and are not intended to limit the scope of the invention.

EXAMPLES

Example 1

200 g of polyester resin, 10 g of cyan pigment, PB 15:3, 7 g of ester wax and 200 g of tetrahydrofuran were injected in a 1,000 ml container, and stirred at room temperature to prepare a polyester mixture. In another 1,000 ml container where a homogenizer is installed, 10 g of polyethylene glycol methacrylate (PEG-MA (Aldrich)) was dissolved in 200 ml of ultra-high pure water, and the polyester mixture was injected and homogenized for 3 minutes at 10,000 RPM to form a dispersion. The dispersion was transferred to a reactor having an impeller-type agitator and the inside of the reactor was purged with nitrogen gas at a temperature of 80° C. and stirred until the tetrahydrofuran was removed. When the tetrahydrofuran was removed sufficiently, 0.3 g of potassium persulfate was injected. 20 g of a mixture of styrene, butylacrylate and methacrylic acid at a ratio of 7:2:1 were prepared and injected into the reactor slowly for about an hour through a dropwise addition funnel. The total reaction time was 3 hours. After the reaction, the product was stirred and naturally cooled. The average volumetric particle size of the particles produced was 7.2 μm.

Example 2

The process of Example 1 was repeated except that 10 g of PEG-ethyl ether methacrylate (EEMA) was used instead of PEG-MA. The average volumetric particle size of the particles produced was 8.2 μm and the number average size was 7.6 μm.

Comparative Example

Conventional Emulsion/Aggregation Process

Preparation of Latex 0.5 g of sodium dodecyl sulfate (SDS) as an anionic surfactant, was mixed in 400 g of ultra-high pure water that was deoxidized. The aqueous solution was placed into a reactor and heated to 80° C. When the temperature reached 80° C., an initiator, which was a solution of 0.2 g of potassium persulfate in 30 g of ultra-high pure water, was added. After 10 minutes, 105.5 g of styrene, butylacrylate and methacrylic acid (each 81 g, 22 g, 2.5 g respectively) were added dropwise for about 30 minutes. After allowing a reaction to proceed for 4 hours, the heating was stopped and the product was allowed to cool naturally. 30 g of the resultant seed solution was removed and added to 351 g of ultra-high pure water, and the result was heated to 80° C. 17 g of ester wax was heated and dissolved together with 18 g of monomer styrene, 7 g of butylacrylate, 1.3 g of methacrylic acid, and 0.4 g of dodecanethiol. The prepared wax/mixed monomer was added to 220 g of ultra-high pure water in which 1 g of SDS was dissolved, and the result was homogenized for about 10 minutes in an ultrasonic homogenizer. The homogenized emulsified solution was placed into the reactor and after about 15 minutes, 5 g of the initiator and 40 g of ultra-high pure water were mixed and added to the reactor. During this time, the reaction temperature was maintained at 82° C. and the reaction was allowed to continue thereafter for about 2 hours and 30 minutes. After the reaction was performed for 2 hours and 30 minutes, 1.5 g of the initiator and 60 g of ultra-high pure water were again added together with a monomer for shell layer formation. The monomer was composed of 56 g of styrene, 20 g of butylacrylate, 4.5 g of methacrylic acid, and 3 g of dodecanethiol. The monomer was added dropwise to the reactor for about 80 minutes. After the reaction was performed for two hours, the reaction was stopped and the product was allowed to cool naturally.

Toner Aggregation/Melting Process 318 g of latex particles prepared as described above were mixed with ultra-high pure water in which 0.5 g of an SDS emulsifier was dissolved. 18.2 g of pigment particles (cyan 15:3, 40 solidity%) dispersed by the SDS emulsifier were added to obtain a latex pigment dispersed aqueous solution. While stirring at 250 RPM, the pH of the latex pigment dispersed aqueous solution was titrated to pH 10 using a 10% NaOH buffer solution. 30 g of ultra-high pure water was dissolved in 10 g of $MgCl_2$ as an aggregating agent, and the resultant mixture was added dropwise to the latex pigment aqueous solution for about 10 minutes. The temperature of the resultant mixture was increased to 95° C. at a rate of 1° C./min. After about 3 hours of heating, the reaction was stopped and the product was allowed to cool naturally. The average volumetric particle size was about 6.5 μm.

The present invention has the following advantages.

First, a polyester resin, having superior fixability at low temperature and image properties, is used as a core composition and styrene, having superior maintenance and charging properties, is used as a shell composition in the process of manufacturing a core/shell structure to prepare the toner for the image forming apparatus having fast speed and fixability of high quality images at low temperature.

Second, by using a reactive emulsifying agent, the cleaning process is simplified, and generation of polluted water and waste water is decreased, which is very advantageous environmentally.

Third, regulating the configuration and the size of the toner particles are easy, anti-offset, friction electric charge property and storage stability are superior, and thus, high quality images can be printed.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A toner comprising a core and a shell, wherein the core is prepared by mixing a polyester resin and a colorant with at least one material selected from the group consisting of a macromonomer and a reactive emulsifying agent wherein said macromonomer has a hydrophilic group, a hydrophobic group, and at least one reactive functional group; and wherein the shell is prepared by polymerizing an exterior surface on the core with one or more polymerizable monomers and an initiator, wherein at least one material selected from the group consisting of the macromonomer and the reactive emulsifying agent participate in the polymerization reaction, wherein the polyester resin comprises polyester moiety and at least two reactive groups selected from the group consisting of a vinyl group, an acrylate group and a methacrylate group.

2. The toner of claim 1, wherein a radical formed by the initiator reacts with the polymerizable monomer, the reactive functional group of the macromonomer, and the reactive emulsifying agent to form a copolymer, and the copolymer has a weight average molecular weight in the range of 2,000 to 200,0000.

3. The toner of claim 1, wherein the average volumetric particle size of the toner particle is in the range of 0.5 to 20 μm.

4. The toner of claim 1, wherein the weight average molecular weight of the macromonomer is in the range of 100 to 100,000.

5. The toner of claim 1, wherein the macromonomer is a material selected from the group consisting of polyethylene glycol (PEG)-methacrylate, PEG-ethyl ether methacrylate, PEG-dimetacrylate, PEG-modified urethane, PEG-modified polyester, polyacrylamide (PAM), PEG-hydroxyethyl methacrylate, hexafunctional polyester acrylate, dendritic polyester acrylate, carboxy polyester acrylate, fatty acid modified epoxy acrylate, and polyester methacrylate.

6. The toner of claim 1 further comprising at least one material selected from the group consisting of wax, a charge control agent, and a release agent.

7. The toner of claim 1, wherein the polyester resin has a weight average molecular weight of 5,000 to 120,000.

8. The toner of claim 1, wherein the polyester resin is included in an amount of 1,000 to 10,000 parts by weight based on 100 parts by weight of the colorant.

9. An image forming method comprising:

forming a visible image by depositing the toner of claim 1 on a photoreceptor surface having an electrostatic latent image thereon; and transferring the visible image to a transfer medium.

10. A toner comprising a core and a shell, wherein the core is prepared by mixing a polyester resin and a colorant with at least one material selected from the group consisting of a macromonomer and a reactive emulsifying agent wherein said macromonomer has a hydrophilic group, a hydrophobic group, and at least one reactive functional group; and wherein the shell is prepared by polymerizing an exterior surface on the core with one or more polymerizable monomers and an initiator, wherein at least one material selected from the group consisting of the macromonomer and the reactive emulsifying agent participate in the polymerization reaction, wherein a radical formed by the initiator reacts with the polymerizable monomer, the reactive functional group of the macromonomer, and the reactive emulsifying agent to form a copolymer, and the copolymer has a weight average molecular weight in the range of 2,000 to 200,000.

* * * * *